United States Patent [19]

Reed

[11] Patent Number: 4,676,484

[45] Date of Patent: Jun. 30, 1987

[54] HELICOPTER TRANSPORTABLE TRAVELING BLOCK

[75] Inventor: Lowell M. Reed, Del City, Okla.

[73] Assignee: Parco Mast and Substructure, Inc., Del City, Okla.

[21] Appl. No.: 834,345

[22] Filed: Feb. 28, 1986

[51] Int. Cl.[4] ..... B66D 3/06

[52] U.S. Cl. ..... 254/402; 254/405

[58] Field of Search ..... 254/401, 402, 403, 405, 254/393

[56] References Cited

U.S. PATENT DOCUMENTS

| | | | |
|---|---|---|---|
| 3,421 | 1/1844 | Waterman | 254/393 |
| 1,271,869 | 7/1918 | Dunseath | 254/401 |
| 1,603,730 | 10/1926 | Wilkinson | 254/401 |
| 2,502,570 | 4/1950 | Johnson | 254/402 |
| 2,650,403 | 9/1953 | Taylor | 254/402 X |

FOREIGN PATENT DOCUMENTS

| | | | |
|---|---|---|---|
| 17293 | 9/1893 | United Kingdom | 254/393 |

*Primary Examiner*—Stuart S. Levy
*Assistant Examiner*—Katherine Matecki
*Attorney, Agent, or Firm*—Head, Johnson & Stevenson

[57] ABSTRACT

A helicopter transportable traveling block having means for ready assembly and disassembly into component portions of preselected maximum weight, the traveling block being formed into two sub-assemblies, each having an inner and outer plate with a shaft therebetween and a plurality of sheaves rotatably supported on the shaft between the inner and outer plates. The lower portions of both the inner and outer plates of each sub-assembly has perpendicularly extending clevis support and bracket members with aligned openings therebetween, the clevis support members also having lower openings. Bolts are positioned in the aligned openings of the clevis support and bracket members for each sub-assembly to retain the lower end of the sub-assembly together. A U-shaped clevis is secured to the clevis support members of each of the sub-assemblies to thereby retain the sub-assemblies together at the lower end. At the upper end of each sub-assembly the inner and outer plates have radially extending clip members and coupling members which overlap with each other. Bolts received in aligned holes in the overlapped clip and coupling member secure the sub-assembly together and overlapping portions of the coupling member receive a bolt which also supports a sling member so that the upper portion of the sub-assembly is held together. By breaking down the traveling block into sub-assemblies or portions thereof the maximum weight required to transport the traveling block can be minimized while the traveling block is easily assembled after being transported.

6 Claims, 4 Drawing Figures

HELICOPTER TRANSPORTABLE TRAVELING BLOCK

SUMMARY OF THE INVENTION

Drilling oil wells sometimes takes place in highly inaccessible areas of the world, particularly in jungle or marsh areas where it is extremely difficult to build roads to a drilling location. For this reason a common expedience is to transport the equipment necessary to conduct drilling by means of helicopters. One of the heavy items on a drilling rig is a traveling block. The traveling block is the lower end of a cable assembly in which the crown block at the upper part of the derick forms the upper end with a plurality of cables extending between sheaves in the crown block and in the traveling block. The traveling block is moved up and down to support drill pipe as it is moved in and out of the hole and to support the drill pipe during the drilling operation. In the past these crown blocks have been unitary structures, not easily assembled or disassembled and not easily separated into sub-assemblies or into components so that the maximum load required to transport the elements to make up a traveling block could be easily reduced.

The present invention is directed towards a traveling block in which the components thereof may be broken down into sub-assemblies so that the maximum load which must be transported, such as by helicopter, can be below a preselected allowable maximum. The helicopter transportable traveling block of this invention is formed of a first vertical outer plate having a central opening and a first vertical inner plate likewise having a central opening. A first horizontal shaft is received in the openings in the first inner and outer plates so that the plates are supported parallel and spaced from each other. A plurality of sheaves, such as two, three or four, are received on the first central shaft between the first inner and outer plates. Means is provided at the upper and lower ends of the first inner and outer plates to couple them together so that a first sub-assembly is accomplished.

A second sub-assembly is formed in the same way of an inner and outer plate, shaft, sheaves, and means at the upper and lower end for coupling the plates together.

An integral portion of the members utilized to couple the inner and outer plates of each sub-assembly together includes a clevis support member which has, at the lower end thereof, an opening. A U-shaped clevis is utilized to retain the lower portions of the two completed sub-assemblies together by attaching it to the clevis support members by means of bolts. The clevis is used, during drilling operations, to attach a drilling hook to the traveling block.

At the upper end of each sub-assembly are clip members and coupling members which extend perpendicularly to the plane of the inner and outer plates and towards each other in overlapping relationships with aligned holes therebetween. Bolts received in the holes support the upper portions of the sub-assemblies together. The coupling members have inwardly extending portions which overlap with an aligned opening therein. By means of a bolt extending through a U-shaped sling shackle and the aligned openings in the coupling members the upper ends of the sub-assemblies are secured to each other. The sling shackle has two purposes; first as a means of connecting the upper portions of the sub-assemblies together and second as a device for use in tying off the traveling block when slipping drilling line or for use in carrying the traveling block when assembled.

A typical traveling block for use in a deep well drilling rig may vary in weight between 10,000 to 21,000 pounds. In some instances it is desirable to break down all loads which a helicopter must transport into packages of less than 6,000 pounds. The present traveling block can easily be separated into sub-assemblies of less than 6,000 pounds and the sub-assemblies very quickly and expeditiously connected to each other by the attachment of the clevis and sling shackle on location so that the traveling block is quickly placed in condition for use. If it is desired to reduce the maximum weight even further, means is provided so that the outer plates of each sub-assembly can be removed to thereby reduce the weight of each sub-assembly substantially.

A better understanding of the invention will be had by reference to the following description and claims, taken in conjunction with the attached drawing.

DESCRIPTION OF THE DRAWING

FIG. 1 shows the traveling block without a cable where FIGS. 2 and 3 show the traveling block in use with a cable in place.

DESCRIPTION OF THE PREFERRED EMBODIMENT

Figure 1:
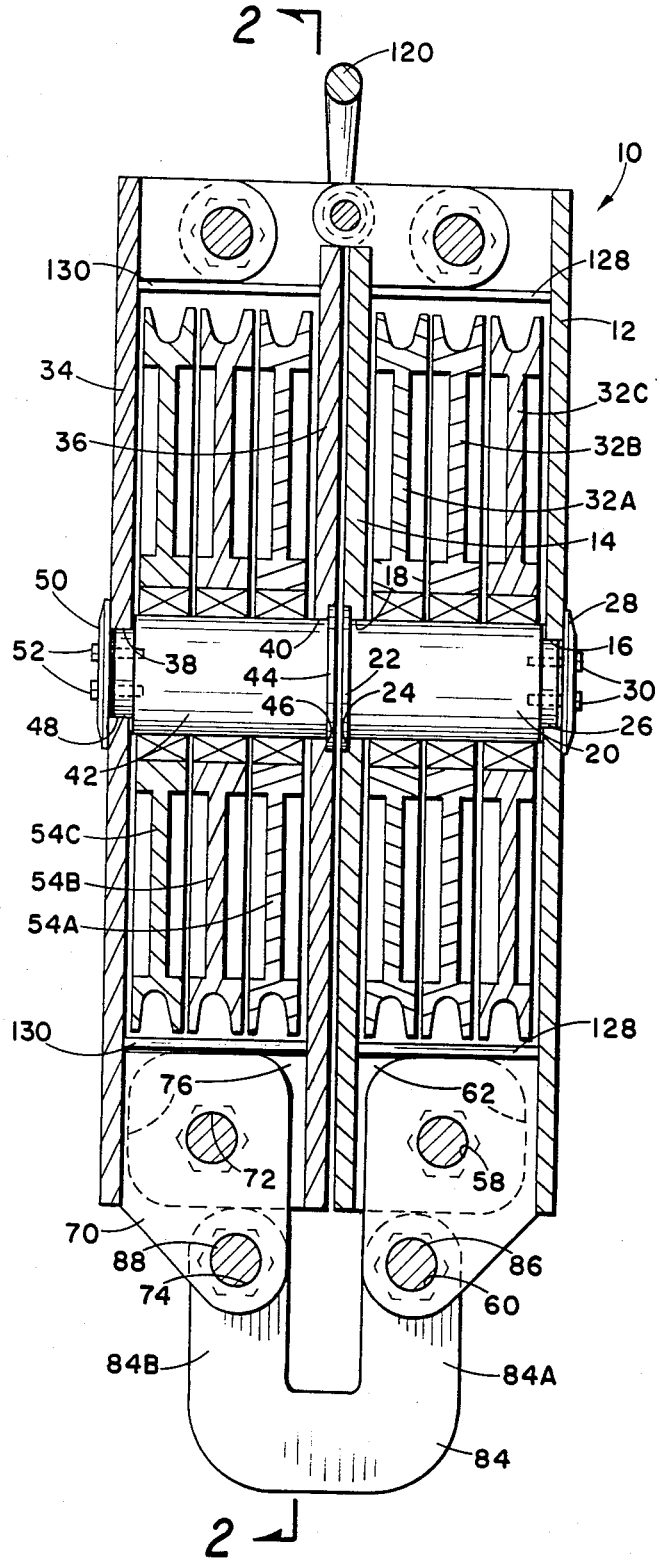
FIG. 1 is an elevational cross-sectional view of a helicopter transportable traveling block according to the present invention and shown fully assembled ready for use in a drilling rig.

Referring to the drawings the helicopter transportable drilling rig of this invention is generally indicated by the numeral 10. The traveling block is basically formed of a first and second, substantially identical, sub-assembly. The first sub-assembly is formed by a first outer plate 12 and a first inner plate 14 having openings 16 and 18 respectively. Received in openings 16 and 18 is a first central shaft 20. The central shaft includes, at its inner end, an enlarged integral flange portion 22. This is received in a circumferential recess 24 so that the flange 22 retains the inner plate 14.

The other end of the first central shaft 20 has a reduced diameter portion 26 which is received in the opening 16. An end cap 28 is secured to the outer end of shaft 20 by means of bolts 30.

Received on the first central shaft 20 are sheaves 32A, 32B, 32C, the sheaves being supported on bearings about the shaft 20 and between the inner and outer plates 12 and 14. The other sub-assembly is formed identically to the portions described with a second outer plate 34, a second inner plate 36, openings 38 and 40, second central shaft 42, flange portion 44 on shaft 42, recess 46 in inner plate 36, a reduced diameter portion 48 on shaft 42, end cap 50, bolts 52, and sheaves 54A, 54B and 54C. Each of the two sections form a sub-assembly.

Affixed to the first outer plate 12 are a first pair of spaced apart clevis support members 56A and 56B. The clevis support members are at the lower end of plate 12, below the sheaves 32 and extend perpendicular to the plane of plate 12 and inwardly towards the inner plate 14. Each of the clevis support plates has an upper opening 58 and a lower opening 60. Extending from the first inner plate 14 in an outer direction, towards the outer plate 12, and in a plane perpendicular to the plane of the plate 14, is a first bracket member 62, the bracket member extending between the clevis support members 56A and 56B and having an opening 64 therein in alignment with openings 58. A bolt 66 held by nut 68 secures the lower ends of the inner and outer plates together.

In like manner, the lower end of second inner and outer plates 34 and 36 are provided with paralleled clevis support members 70 having upper openings 72 therein and lower openings 74, a second bracket 76 having an opening 78, bolt 80, a nut 82 by which the lower portion of the second sub-assembly including second inner and outer plates 34 and 36 is held together.

To hold the lower portions of the sub-assemblies together, a U-shaped clevis 84 is employed, the clevis having extending leg portions 84A and 84B, each of the leg portions having an opening therein in alignment with the openings 60 and 74. By means of bolts 86 and 88 and nuts 90 (only one of which is shown) the lower portion of the two sub-assemblies are held together.

The clevis 84 not only functions to hold the lower portion of the sub-assemblies together but also forms the means of attaching the drilling hook (not shown) to the traveling block as used in the operation of drilling an oil well.

The upper end of the sub-assemblies are held together, and to each other, in a somewhat similar way. Affixed to the second outer plate 34 are a pair of inwardly extending, spaced apart, paralleled clip members 92A and 92B, the clip members being perpendicular to the plane of second outer plate 34. Affixed to the second inner plate 36 is a single outwardly extending coupling member 94 which extends perpendicular to the plane of the second inner plate 36 and which is received between the clip members 92A and 92B. The clip members have aligned openings 96 and the coupling member has an opening 98 in alignment with openings 96, the aligned opening receiving a bolt 100 secured by a nut 102 by which the second sub-assembly is secured at its upper end.

Extending from the upper end of the first outer plate 12 is a single clip member 104 and extending from the first inner plate 14 are a pair of coupling members 106A and 106B. The member 104 and members 106A and 106B have aligned openings 108 and 110, respectively, therein which receive a bolt 112 secured by nut 114 by which the first sub-assembly is held together.

The coupling members 94, 106A, and 106B each have an inwardly extending portion providing an overlapping relationship with aligned openings 116 and 118, respectively. A sling shackle 120 is employed having spaced apart, parallel legs 120A and 120B, each of which has an opening 122 herein. A pin 124 is received in the openings in the shackle and the openings 118 and 116 and the clip member and coupling members, respectively, so that the upper portion of the sub-assembly is secured together. The shackle 120 not only serves to retain the sub-assemblies together at their upper ends but also provides a device to tie off the traveling block when slipping drilling line and when handling or carrying the traveling block after it is fully assembled as shown in the drawings.

Figure 2:
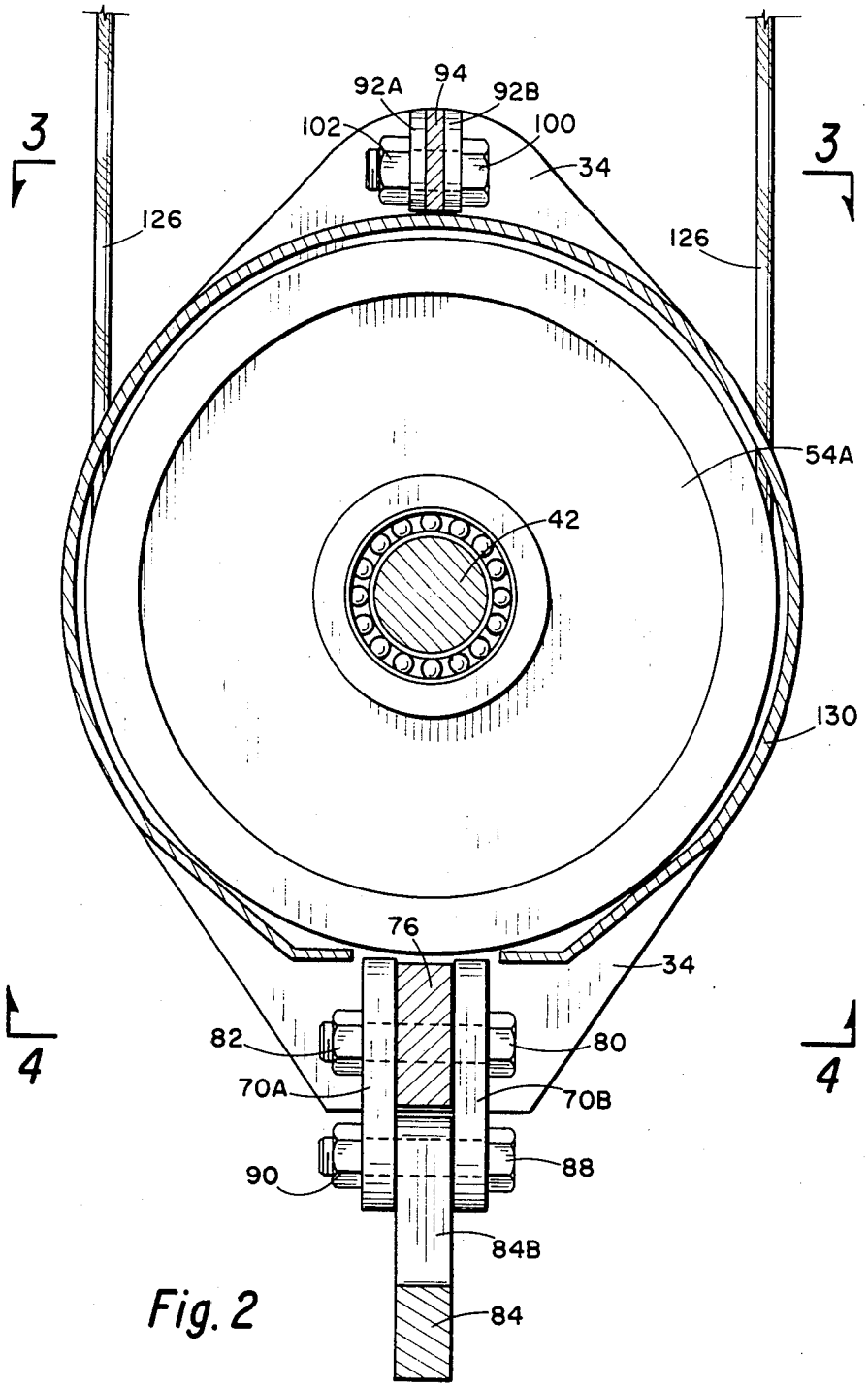
FIG. 2 is an elevational cross-sectional veiw taken along the line 2—2 of FIG. 1.
Figure 3:
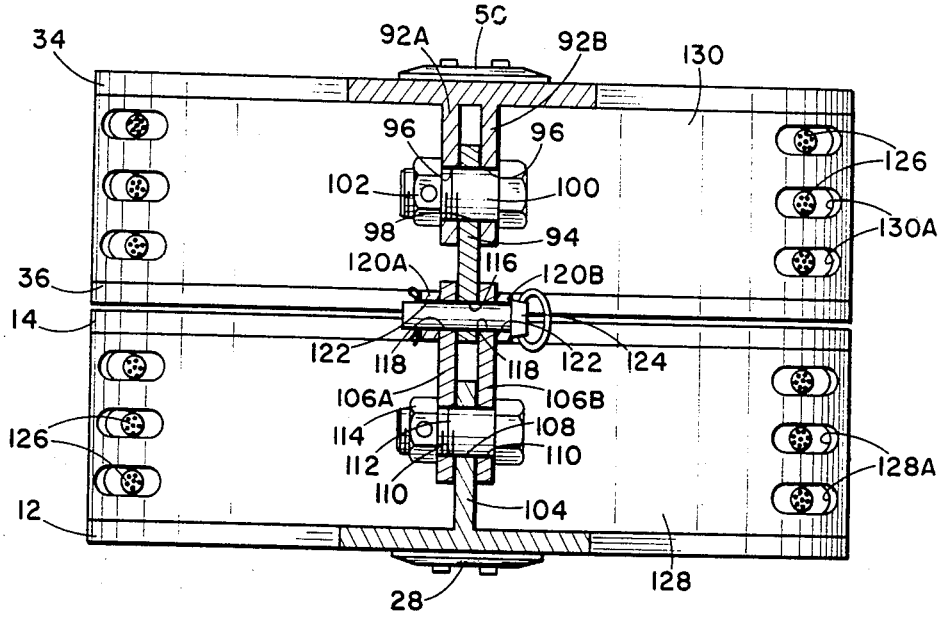
FIG. 3 is a top, partial cross-sectional view, taken along the line 3—3 of FIG. 2 and looking downwardly.
Figure 4:
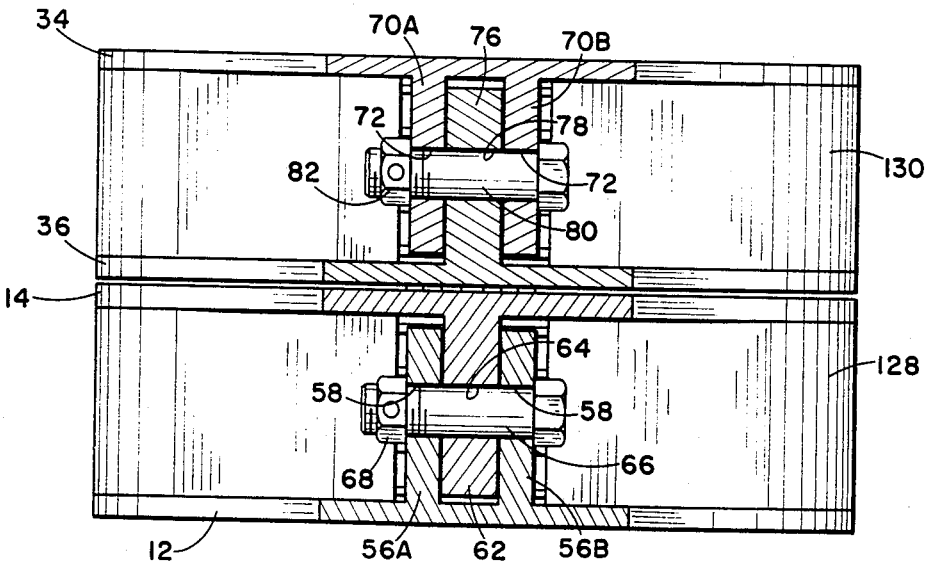
FIG. 4 is a bottom, partial cross-sectional view, taken along the line 4—4 of FIG. 2, looking upwardly.

FIGS. 2 and 3 show cable or line 126 on the sheaves. Further, a first guard 128 is placed between the first outer and inner plates 12 and 14 and, in like manner, a second guard 130 is positioned between the second inner and outer plates 34 and 36. The guards have openings 128A and 130A, respectively, therein to receive cable 126.

The invention described provides a unique traveling block which is particularly useful for helicopter transportable drilling rigs wherein the maximum weight a helicopter can easily transport is limited. The traveling block can easily be broken into sub-assemblies to reduce the total weight of the traveling block by at least fifty per cent. The sub-assemblies are expeditiously attached to each other to form a unitary traveling block by attachment of the clevis 24 and sling shackle 120 when the components are ready to be assembled for use, and it can be seen that disassembly can be just as expeditiously accomplished.

If it is desired to further reduce the weight of the sub-components one method is to remove the outer plate 12 and 36 from each sub-assembly by removing the end caps 28 and 50. To retain the sheaves in position, a large washer (not shown) can be received on the shaft's reduced diameter portions 26 and 48, respectively, and the end caps replaced by means of bolts 30 and 52. In this way the outer plates 12 and 34 can be separately transported and yet can be easily attached to the sub-assemblies when it is desired to assembly the traveling block.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A helicopter transportable traveling having means for ready assembly and disassembly into component portions of preselected maximum weight, comprising:

a first vertical outer plate having a central opening;

a first vertical inner plate having a central opening;

a first horizontal shaft received in said openings in said first inner and outer plates, the first plates being supported parallel to and spaced from each other;

a plurality of sheaves received on said first central shaft between said outer and inner plates;

means for removably coupling said first outer and inner plates together above and below said sheaves to provide a first sheave sub-assembly;

a second vertical outer plate having a central opening;

a second vertical inner having a central opening;

a second horizontal shaft received in said openings in said second plates, the second plates being supported parallel to and spaced from each other;

means for removably coupling said second outer and inner plates together above and below said sheaves to provide a second sheave sub-assembly;

means of removably coupling the upper portion of said first and second sheave sub-assemblies together wherein said shafts are co-axial;

a U-shaped clevis means having opposed upwardly extending leg portions; and means of removably affixing the upper ends of said clevis member leg portions to the lower ends of said sheave sub-assemblies whereby said sub-assemblies are held together at the lower ends thereof and said clevis means provides means for supporting a weighted member to said traveling block.

2. A helicopter transportable traveling block according to claim 1 wherein one of said outer plates has a pair of spaced apart paralleled inwardly extending clip members at the upper end thereof above said sheaves and the other outer plate has a single inwardly extending clip member at the upper end thereof above said sheaves, and wherein one of said inner plates has a single coupling member affixed thereto and extending perpendicularly therefrom, a portion of the single coupling member being received between said pair of clip members, the pair of clip members and single coupling members having aligned opening therein receiving a bolt therethrough providing at least in part, said means of retaining said inner and outer plates at one of said sub-assemblies together, and the other inner plate having affixed thereto at the upper end thereof above said sheaves a pair of paralleled coupling members which receive therebetween said clip member extending from the other of said outer plates, the pair of coupling members and the single clip member having aligned holes therein receiving a bolt providing, at least in part, said means of retaining said inner and outer plates together.

3. A helicopter transportable traveling block according to claim 2 in which each of said coupling members extend inwardly beyond said inner plates to which they are attached so that the inwardly extending portion of said single coupling member is received between the inwardly extending portion of said pair of coupling members, the inwardly extending portion of said coupling members having aligned openings therein;

an inverted U-shaped sling shackle having opposed legs each having an opening in the lower end thereof; and a bolt received in said sling shackle holes and said aligned holes in said coupling members inwardly extending portions.

4. A helicopter transportable traveling block having means for ready assembly and disassembly into component portions of preselected maximum weight, comprising;

a first vertical outer plate having a central opening;

a first vertical inner plate having a central opening;

a first horizontal shaft received in said openings in said first inner and outer plates, the first plates being supported parallel to and spaced from each other;

a plurality of sheaves received on said first central shaft between said outer and inner plates;

means for removably coupling said first outer and inner plates together above and below said sheaves to provide a first sheave sub-assembly;

a second vertical outer plate having a central opening;

a second vertical inner plate having a central opening;

a second horizontal shaft received in said openings in said second plates, the second plates being supported parallel to and spaced from each other;

means for removably coupling said second outer and inner plates together above and below said sheaves to provide a second sheave sub-assembly;

means of removably coupling the upper portion of said first and second sheave sub-assemblies together wherein said shafts are co-axial, wherein each said outer plates has, at the lower end thereof below said sheaves, a pair of inwardly extending, spaced apart, clevis support members, each in a plane perpendicular to the plane of the plate, each clevis support member having an upper and a lower hole therein, and wherein each said inner plate has at the lower end thereof an outwardly extending bracket in a plane perpendicular to the plane of the plate, each bracket having an opening therein, the spaced apart clevis support members receiving said brackets therebetween when the sub-assemblies are assembled;

a bolt received in said upper holes of said clevis support members and said hole in said brackets providing at least a portion of said means to removably couple said outer and inner plates together; and means of removably supporting a clevis to the lower portion of said first and second sheave sub-assemblies.

5. A helicopter transportable traveling block according to claim 4 wherein said first and second shafts each include, at the inner end thereof, an integral enlarged flange portion and at the outer end thereof an integral reduced diameter portion providing a radial ledge, the reduced diameter portion being received in said opening in said outer plate; and end cap secured to the outer end of each said shaft.

6. A helicopter transportable traveling block according to claim 4 including:

a U-shaped clevis having spaced apart legs each with a hole therein in the upper ends thereof, the holes having parallel axes, the upper ends of the legs of the clevis being received between said spaced apart clevis support members; and bolts being received in said lower holes of said clevis support members and clevis holes to thereby secure the clevis to the sheave sub-assemblies.

* * * * *